United States Patent [19]

Iwanaga et al.

[11] Patent Number: 5,004,242

[45] Date of Patent: Apr. 2, 1991

[54] IRON GOLF CLUB HEAD AND METHOD OF PRODUCING THE SAME

[75] Inventors: Takeshi Iwanaga, Kobe; Akio Ohnishi, Kakogawa, both of Japan

[73] Assignee: Sumitomo Rubber Industries, Ltd., Kobe, Japan

[21] Appl. No.: 514,309

[22] Filed: Apr. 25, 1990

[30] Foreign Application Priority Data

Jun. 12, 1989 [JP] Japan ..... 1-149230

[51] Int. Cl.[5] ..... A63B 53/04

[52] U.S. Cl. ..... 273/169; 273/DIG. 23; 273/167 J; 273/167 A

[58] Field of Search ..... 273/167-175, 273/77 R, 77 A, 193 R, 194 R, DIG. 7, DIG. 23

[56] References Cited

U.S. PATENT DOCUMENTS

| | | | |
|---|---|---|---|
| 1,720,867 | 7/1929 | Webster et al. | 273/169 |
| 1,968,092 | 7/1934 | Oldham | 273/169 |
| 4,534,558 | 8/1985 | Yoneyama | 273/78 |
| 4,635,941 | 1/1987 | Yoneyama | 273/78 |
| 4,690,408 | 9/1987 | Kobayashi | 273/169 |
| 4,697,814 | 10/1987 | Yamada | 273/169 |
| 4,728,105 | 3/1988 | Kobayashi | 273/169 |
| 4,824,110 | 4/1989 | Kobayashi | 273/78 |

FOREIGN PATENT DOCUMENTS

| | | | |
|---|---|---|---|
| 692197 | 8/1964 | Canada | 273/167 R |
| 2174610 | 11/1986 | United Kingdom | 273/169 |

*Primary Examiner*—Edward M. Coven
*Assistant Examiner*—Sebastiano Passaniti
*Attorney, Agent, or Firm*—William H. Eilberg

[57] ABSTRACT

The present invention provides an iron golf club head which comprises a core member, a striking face member and a cladding. The core member is made of a metal having a large specific weight, and has an exposed integral sole portion, an integral riser wall portion, and an integral shaft connecting portion. The striking face member is fixed to a front surface of the core riser wall portion, and made of a light metal reinforced by whiskers and/or fibers. The cladding is also made of a light metal, and covers all surfaces of the riser wall portion and the shaft connecting portion except for a surface portion of the riser wall portion on which the striking face member is fixed.

9 Claims, 2 Drawing Sheets

IRON GOLF CLUB HEAD AND METHOD OF PRODUCING THE SAME

BACKGROUND OF THE INVENTION

1. Field of the Invention

This invention relates to golf clubs in general. More particularly, the invention relates to an iron club head and method of producing the same.

2. Description of the Prior Art

Iron clubs are often used to make tee shots in short holes or to make fairway shots to carry the ball as close to the pin as possible. The iron club is also used in roughs, bunkers or other hazardous areas to clear these hazards. For these reasons, the iron club is required to hit the ball high and to place the hit ball as exactly intended with less likelihood of erroneous shots.

Obviously, the club head of the iron is required to have a lowered gravitational center for hitting the ball high (large initial shot angle). For this purpose, the iron club head need have an enlarged sole portion. Further, the iron club head as a whole should be as large as possible to increase the moment of inertia and thereby to enlarge the sweet spot area, as required for reducing the likelihood of erroneous shots.

As is well known, a typical material for iron clubs is steel or stainless steel which is relatively large in specific weight. However, if the club head is entirely made of this known material, there is a limitation in enlarging the sole portion of the head (as required for lowering the gravitational center) and enlarging the head as a whole (as required for increasing the sweet spot area). This is because such a design of the steel head results in an unacceptable increase of the overall weight, which has adverse influences on the head speed at the time of swinging the club.

One way to overcome this disadvantage is to use carbon heads for iron clubs. While the carbon head can be enlarged without an unacceptable weight increase, it has a new disadvantage of being easily damaged by repetitive contact with the ground or the ball.

Another alternative is to constitute an iron club head by utilizing a heavy core member (made for example of stainless steel) which is entirely enclosed in a cladding of a light metal such as aluminum or aluminum alloy. Such a club head can be designed to have a lowered gravitational center and an enlarged volume or ball striking area without much increase in overall weight. However, since the sole portion and ball striking face of the head are provided by the light metal which is relatively poor in scratch resistance and abrasion resistance, this head also has the problem of easily damaged during use.

SUMMARY OF THE INVENTION

It is, therefore, an object of the present invention to provide an iron club head which has a lowered gravitational center and an increased moment of inertia while making the sole portion and the ball striking face less liable to damage.

Another object of the present invention is to provide an iron club head which has a greatly increased integrity to prevent separation of various parts of the head during use.

A further object of the present invention is to provide an improved method of producing such a club head.

According to one aspect of the present invention, there is provided an iron golf club head comprising: a core member made member having an exposed integral sole portion, an integral riser wall portion, and an integral shaft connecting portion, the riser wall portion being formed with at least one through-hole extending between front and rear surfaces thereof; a composite striking face member fixed to the front surface of the riser wall portion, the striking face member being smaller in specific weight than the core member; a cladding made of a light metal, the cladding covering all surfaces of the riser wall portion and the shaft connecting portion except for a surface portion of the riser wall portion on which the striking face member is fixed, the cladding having at least one integral projection fitting into the through-hole for connection to the striking face member.

Preferably, the striking face member is made of a light metal such as aluminum and aluminum alloy containing reinforcing whiskers and/or fibers. Further, the striking face member is advantageously rendered integral with the cladding by means of the projection, the cladding being also made of aluminum or aluminum alloy.

According to another aspect of the present invention, there is provided a method of producing an iron golf club head comprising the steps of: preparing a core member made of a metallic material having a large specific weight, the core member having an integral sole portion, an integral riser wall portion, and an integral shaft connecting portion, the riser wall portion having a front surface which provides a mounting region for a striking face member; preparing a porous preform having a shape corresponding to the striking face member; placing the core member and the preform in a cavity of a mold with the preform held in contact with the mounting region of the riser wall portion; and supplying a molten light metal under pressure into the mold cavity, the molten metal being caused to cover all surfaces of the riser wall portion and the shaft connecting portion except for the mounting region of the core riser wall portion to form a light metal cladding, the molten metal being also caused to permeate into the preform to convert it into the striking face member which is integral with the cladding.

Preferably, the riser wall portion of the core member is formed with at least one through-hole by way of which the molten metal is caused to permeate into the preform. In this case, the molten metal forms, upon solidification thereof, an integral projection fitting in the through-hole.

Other objects, features and advantages of the present invention will be fully understood from the following detailed description of the preferred embodiment given with reference to the accompanying drawings.

DETAILED DESCRIPTION

Figure 1:
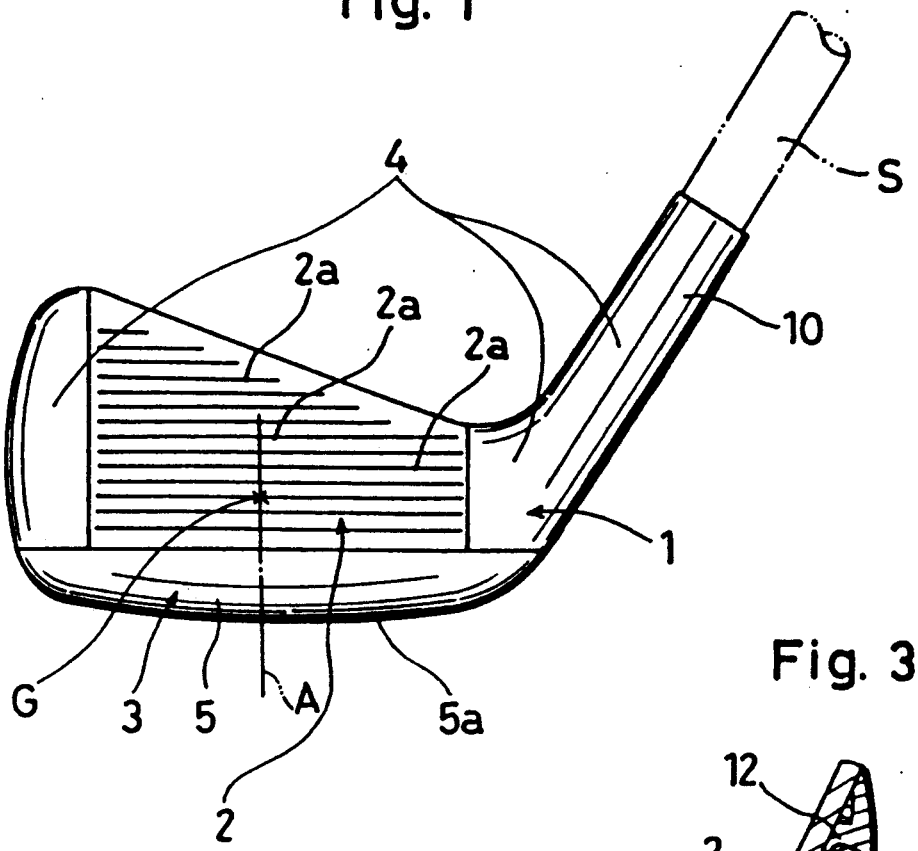
FIG. 1 is a front view showing an iron club head according to the present invention.
Figure 3:
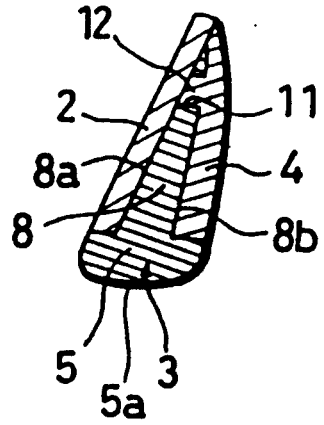
FIG. 3 is a sectional view showing the interior structure of the same head.
Figure 2:
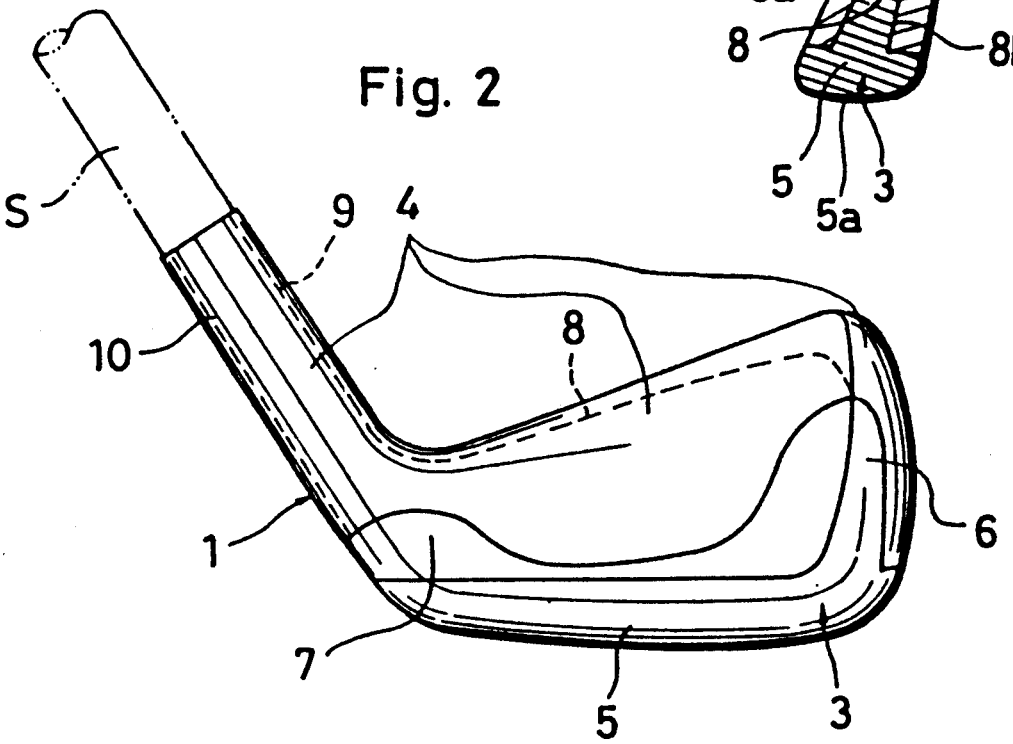
FIG. 2 is a rear perspective view of the same club head.

Referring to FIGS. 1 to 3 of the accompanying drawings, there is illustrated a iron club head 1 connected to a conventional shaft S. The club head mainly comprises a striking face member 2 and a core member 3. Selected portions of the core member 3 are coated with a light metallic cladding 4, as more specifically described hereinafter.

The striking face member 2, which is substantially trapezoidal according to the illustrated example, is made of a composite material consisting of a light metal matrix and a reinforcing material included in the metal matrix. Examples of the metal matrix include aluminum and aluminum alloy. Examples of the reinforcing material include whiskers, fibers, and a mixture of whiskers and fibers. According to the illustrated example, the mixture of SiC whiskers and $Al_2O_3$ is used as the reinforcing material with a volume content of 10–30%.

The whiskers are needle-like perfect crystals which are free from defects such as dislocation, and which are known to exhibit excellent properties such as high strength, high elastic modulus, and light weight. The whiskers may be optionally selected from the group consisting of SiC, $Al_2O_3$, BeO, $B_4C$, $Si_2N_2$, graphite, Cr, Fe, Ni, carbon and any mixture thereof.

The reinforcing fibers may be made of various known materials. Preferably, however, the fibers may be selected from the group consisting of SiC, $Al_2O_3$, BeO, $B_4C$, $Si_2N_2$, graphite, Cr, Fe, Ni, $SiO_2$, carbon, and any mixture thereof.

The striking face member 2 may be formed with a plurality of parallel face lines 2*a*. Of course, such face lines may be provided in any number and arrangement.

Figure 4:
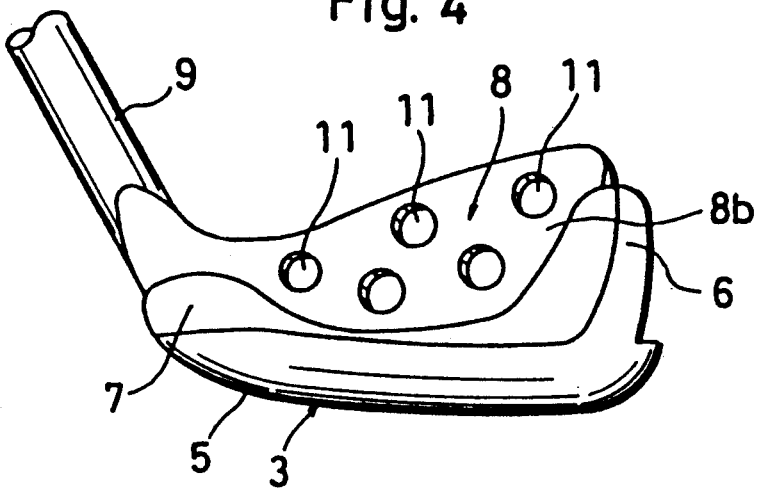
FIG. 4 is a rear perspective view of a core member included in the club head.

As shown in FIG. 4, the core member 3 has an enlarged sole portion 5 which is integrally formed with weight portions 6, 7 at the toe and heel of the club head. The core member has a thinned riser wall portion 8 integrally extending upward from the sole portion. The core member further has a shaft connecting portion 9 integral with the riser wall portion and the sole portion. The striking face member 2 is attached to the front surface 8*a* of the core riser wall portion 8, as better shown in FIG. 3.

The integral core member 3 is made of a metallic material which is relatively large in specific weight. Examples of the core material include stainless steel, aluminum bronze, manganese bronze, and beryllium bronze.

The metallic cladding 4 (see particularly FIG. 3) is made of a light metal such as aluminum or aluminum alloy. This cladding covers the shaft connecting portion 9 of the core member 3. The cladding also covers the entire surfaces of the riser wall portion 8 of the core member except for an area of the riser front surface 8*a* used for mounting the striking face member 2, as clearly understood by comparing FIGS. 1 to 3 with FIG. 4. It should be noted that reference numeral 9 is used to identify the shaft connecting portion before cladding (see FIG. 4), whereas reference numeral 10 is used to identify the same portion after cladding.

To increase the mounting stability or integrity of the metallic cladding 4, the riser wall portion 8 of the core member is formed with through-holes 11, whereas the cladding has integral projections 12 fitting into the through-holes from the rear surface 8*b* of the riser wall portion. These integral projections are simultaneously formed and rendered substantially integral with the striking face member 2 when the cladding 4 is formed by molding, as hereinafter described.

According to the illustrated embodiment, there are provided five through-holes 11 which are circular. However, the number, shape, arrangement, and dimension of the through-holes may be optionally determined depending on various head requirements because these parameters of the through-holes can be also used to adjust the overall head weight and the gravitational center position of the head. For example, the head for a 80 g carbon shaft should be set lighter by 7–10 g than that for a 120 g steel shaft, and such weight adjustment can be conducted by changing the number and/or diameter of the through-holes.

If desired, the core member 3 may be made of a colored metal. In this case, since the sole portion 5 of the core member is exposed and makes a contrast in color against the has integral projections 12 fitting into the through-holes from whole provides an attractive appearance.

With the iron club head 1 described above, the striking face member 3 is made of aluminum or aluminum alloy as reinforced by whiskers and/or fibers, and the cladding 4 is also made of aluminum or aluminum alloy. On the other hand, the core member 3 providing the enlarged sole portion 5, the thinned riser wall portion 8, and the shaft connecting portion 9 is made of a heavier metal such as stainless steel. Thus, it is possible to lower the gravitational center G of the head (see FIG. 1), as compared to conventional iron club heads. In this way, the club head of the present invention is capable of providing a larger initial shot angle than is conventionally obtainable.

Further, the use of a light metal for the striking face member 3 and the cladding 4 contributes greatly to overall weight reduction of the club head 1. This means that the club head can be enlarged in volume or striking face area for a given overall weight, as required for increasing the moment of inertia with respect to a rotational axis A (FIG. 1) which is perpendicular to the sole surface 5*a* and passes through the gravitational center G. For example, in the case of providing the weight portions 3, 4 at the toe and heel of the head, the volume of the head can be increased by 20–30% to provide 20–30% increase of the inertial moment in comparison with a conventional iron club (specifically, the volume increase being 25% relative to an ordinary stainless steel club head). Thus, the sweet spot area of the head is increased to prevent an unacceptable decrease in ball traveling distance at the time of an erroneous shot, thereby providing the golfer with shot stability as well as mental stability.

In spite of the provision of the striking face member 3 and the cladding 4, the sole portion 5 is kept exposed. This sole portion or the core member 3 is made for example of stainless steel which is excellent in scratch resistance and abrasion resistance, thereby rendering the sole portion less liable to damages. Further, the striking face member 3 is reinforced by whiskers and/or fibers to provide increased abrasion resistance and durability. It should be noted that the whiskers are relatively expensive but need be provided only at the striking face member, so that the use of this material does not unduly adds to the cost of the head.

The iron club head according to the present invention may be preferably manufactured in the following manner.

Figure 5:
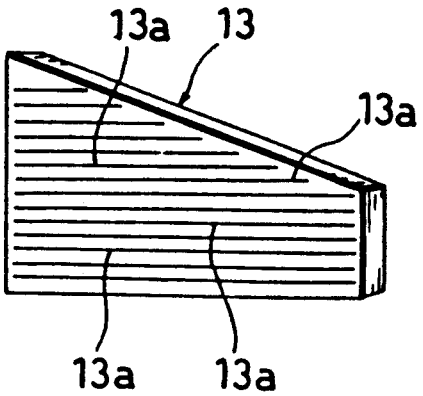
FIG. 5 is a front perspective view of a preform which is used to form a striking face member included in the head.

First, the core member 3 and a preform 13 are separately prepared, as shown in FIGS. 4 and 5 respectively. The shaft connecting portion 9 of the core member has a diameter smaller than the final diameter of the cladded shaft connecting portion 10 to allow for the wall thickness of the cladding 4 subsequently formed. Specifically, the diameter of the non-cladded shaft connecting portion is 2–5 mm smaller than that of the cladded shaft connecting portion.

The preform 13 is made of whiskers and/or fibers which are shaped under pressure to have dimensions corresponding to those of the striking face member 2. To provide a self-sustaining capability, the preform should preferably contain a small amount of a resinous binder. The preform thus formed is highly porous and relatively fragile. Specifically, the porosity or void ratio of the preform is 70–90% of the total preform volume.

Figure 6:
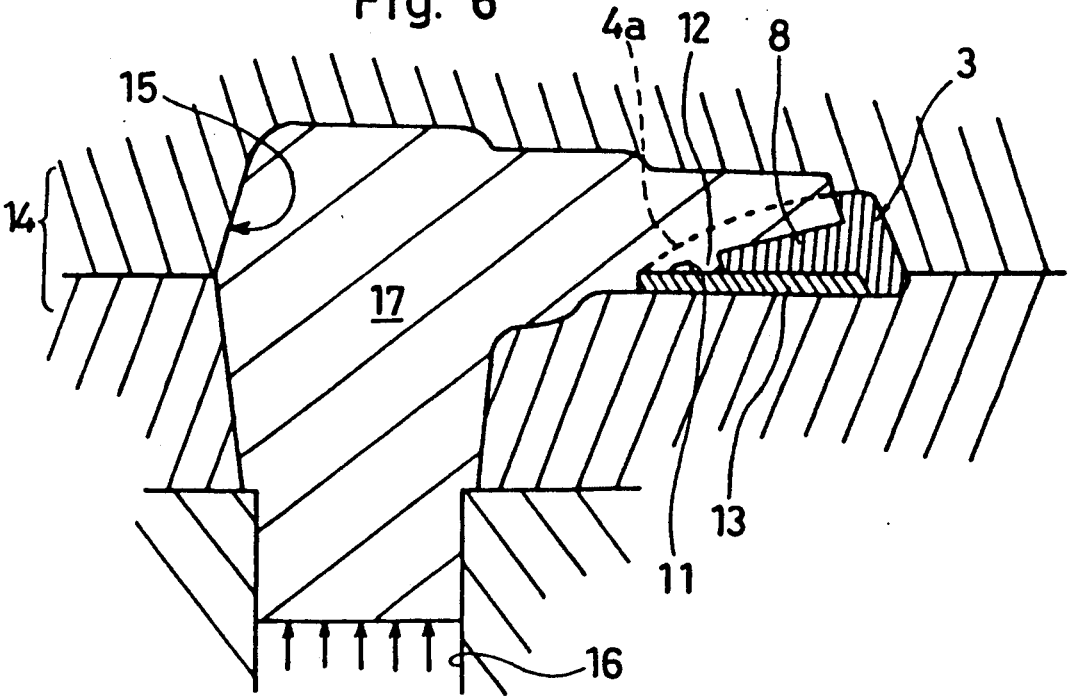
FIG. 6 is a sectional view of a mold which is used to manufacture the club head of the invention.

In the next process step, the preform 13 is attached to the front surface 8*a* of the riser wall portion 8 of the core member 3, and placed in a mold 14, as shown in FIG. 6. This mold has a runner 15 connected to a pressuring passage 16. Aluminum or aluminum alloy 17 in molten state is supplied under pressure through the passage 16 and the runner 15, as indicated by arrows in FIG. 6. The supply pressure for the molten metal 17 is preferably 300–500 kg/cm$^2$. When the supply pressure is 500 kg/cm$^2$ for example, the total pressure at the passage 16 becomes 25,400 kg.

As a result of the high pressure injection molding, the molten metal 17 flows through the through-holes 11 of the core riser wall portion 8, and permeates into the preform 13 to fill the void volume thereof. The molten metal also covers the specified portions of the core member 3 as required to form the cladding 4.

After solidification of the molten metal 17, the mold 14 is opened, and unnecessary portions of the solidified metal is cut away to provide a final profile 4*a* (indicated by a broken line in FIG. 6) of the cladding 4. Finally, the shaft S is connected to the cladded shaft connecting portion 10 of the club head 1 in a known manner, as shown in FIGS. 1 and 2.

Preferably, the preform 13 may be formed with parallel grooves 13*a* which subsequently become the face lines 2*a* of the striking face member 2 (see FIGS. 1 and 5). In this case, the mold 14 is formed with complementary projections (not shown in FIG. 6), so that the grooves 13*a* are not filled with the permeating molten metal 17 during the high pressure injection molding. In this way, the face lines 2*a* of the striking face member 2 are formed simultaneously with the molding of the cladding 4, thereby simplifying the manufacturing process. However, it is of course possible to use a preform without parallel grooves and to form the face lines 2*a* after molding the club head.

According to the method of the present invention, the porous preform 13 provides the composite striking face member 2 when impregnated with the molten metal 17 which is also used to form the cladding 4. Thus, the striking face member 2 is rendered integral with the cladding 4 by the intermediary of the projections 12, thereby firmly retaining the striking face member in place. Further, the method of the present invention enables substantially simultaneous formation of the striking face member 2 and the cladding 4. Obviously, this manner of formation is much more easier than separately preparing a composite striking face member and attaching it to a predetermined portion of a separately cladded core member.

Moreover, the use of the preform 13 for formation of the composite striking face member 2 is also advantageous in the capability of obtaining uniform distribution of the reinforcing whiskers and/or fibers. Such uniform distribution of the reinforcing material is very significant in accurately controlling the weight distribution of the club head 1 as a whole. In contrast, if reinforcing whiskers and/or fibers are dispersed in a molten metal which is subsequently molded and solidified to provide a composite striking face member, intended uniform distribution cannot be obtained because of easy movability of the reinforcing material before solidification of the molten metal.

It should be appreciated that the method according to the present invention can be successfully carried out even if the riser wall portion 8 is not formed with the through-holes 11. This is because the molten metal 17 can permeate into the preform 13 sidewise on the front surface 8*a* (FIG. 3) of the riser wall portion (see, in FIG. 1, the portions of the cladding 4 located on both sides of the striking face member 2).

The present invention being thus described, it is obvious that the same may be varied in many ways. For instance, the striking face member 2 and the cladding 4 may be made of any light metal other than aluminum or aluminum alloy. Similarly, the core member 3 may be made of any heavier metal other than those described herein. Further, the overall configuration of the iron club head is optional. Such variations are not to be regarded as a departure from the spirit and scope of the invention, and all such modifications as would be obvious to those skilled in the art are intended to be included within the scope of the following claims.

We claim:

1. An iron golf club head comprising:

a core member made of a metallic material having a large specific weight, said core member having an exposed integral sole portion, an integral riser wall portion, and an integral shaft connecting portion, said riser wall portion being formed with at least one through-hole extending between front and rear surfaces thereof;

a composite striking face member fixed to said front surface of said riser wall portion, said, striking face member having a specific weight smaller than that of said core member;

a cladding made of a lightweight metal, said cladding covering all surfaces of said riser wall portion and said shaft connecting portion except for a surface portion of said riser wall portion on which said striking face member is fixed, said cladding having at least one integral projection fitting into said through-hole for connection to said striking face member.

2. The club head as defined in claim 1, wherein said striking face member is made of a lightweight metal containing a reinforcing material, said striking face member being rendered integral with said cladding by means of said projection.

3. The club head as defined in claim 1, said sole portion of said core member has a toe and a heel each integrally formed with a weight portion.

4. The club head as defined in claim 1, wherein said core member is made of a metal selected from the group consisting of stainless steel, aluminum bronze, manganese bronze, and beryllium bronze.

5. The club head as defined in claim 1, wherein said core member is made of a colored metal having a large specific weight.

6. The club head as defined in claim 2, wherein said striking face member is made of aluminum or aluminum alloy reinforced with either whiskers or fibers.

7. The club head as defined in claim 6, wherein said whiskers are selected from the group consisting of SiC, $Al_2O_3$, BeO, $B_4C$, $Si_2N_2$, graphite, Cr, Fe, Ni, carbon, and any mixture thereof.

8. The club head as defined in claim 6, wherein said fibers are selected from the group consisting of SiC, $Al_2O_3$, BeO, $B_4C$, $Si_2N_2$, graphite, Cr, Fe, Ni, $SiO_2$, carbon, and any mixture thereof.

9. The club head as defied in claim 1, wherein said cladding is made of aluminum or aluminum alloy.

* * * * *